United States Patent [19]

Huang

[11] Patent Number: 4,842,269

[45] Date of Patent: Jun. 27, 1989

[54] MULTI-FUNCTIONAL STATIONARY BIKE FOR GYMNASTIC PURPOSE

[76] Inventor: Gwo-Ming Huang, No. 181, Lane 412, Chenhsing Rd., Taichung, Taiwan

[21] Appl. No.: 139,759

[22] Filed: Dec. 30, 1987

[51] Int. Cl.[4] ..... A63B 21/00; A63B 21/22

[52] U.S. Cl. ..... 272/73; 272/132; 74/31

[58] Field of Search ..... 272/73, 71, 72, 132, 272/134, 93; 280/249, 260; 74/29, 31; 128/25 R, 25 B

[56] References Cited

U.S. PATENT DOCUMENTS

| | | | |
|---|---|---|---|
| 762,159 | 6/1904 | Fillman et al. | 74/31 |
| 1,620,146 | 3/1927 | Walton | 272/71 |
| 3,731,921 | 5/1973 | Andrews, Jr. | 272/71 |
| 3,865,366 | 2/1975 | Stantial | 272/73 |
| 4,430,902 | 2/1984 | McClure | 74/31 |
| 4,688,791 | 8/1987 | Long | 272/73 |

*Primary Examiner*—Richard J. Apley
*Assistant Examiner*—S. R. Crow
*Attorney, Agent, or Firm*—Leonard Bloom

[57] ABSTRACT

A stationary exercise bike that includes a foot-exercise mechanism that rotates and a hand-exercise mechanism that rotates. In addition to the rotational movement, both the foot-exercise mechanism and the hand-exercise mechanism simultaneously move in a reciprocating manner. The foot-exercise mechanism makes reciprocating upward and downward movements in a vertical plane and the hand-exercise mechanism makes reciprocation forward and backward movements in a horizontal plane. The height of the hand-exercise mechanism and the seat of the bike are adjustable, so that they may be positioned at a proper height and angle.

6 Claims, 7 Drawing Sheets

MULTI-FUNCTIONAL STATIONARY BIKE FOR GYMNASTIC PURPOSE

FIELD OF THE INVENTION

The present invention relates to stationary bicycles for gymnastic purposes.

BACKGROUND OF THE INVENTION

The use of conventional stationary bicycles for gymnastic purposes is to imitate the motions of the pedaling on the bicycle. The exerciser grips fixed handles and, using their feet, applies force on the pedals to make the cycling movements in order to cause the rotations of the gravity wheel. Thus, the legs of the user can obtain exercise or the exerciser may simulate the motions of a gymnastic tool by pulling and extending the handles to exercise their hands. However, the conventional stationary bike can only provide the exerciser either the hand pulling and pushing operations, or the pedaling motions with the feet. It is unable to cause the exerciser to move both the hands and the feet simultaneously, especially conventional exercise bicycles cannot cause the exerciser to make the forward or backward movements in both horizontal and vertical planes at the same time that his muscles on the hands and feet are turning the pedals. Thus it is impossible for the user to get sufficient exercises for all muscles on the entire body. Thus, it can be seen that there remains a need for an exercise bicycle having a foot-gearing mechanism that engages a foot-exercise base to cause the pedals to move continuously in reciprocal cycles so that the lower body together with the legs and the muscles of the lower body of the exerciser can obtain adequate exercises and a hand-exercise mechanism including a hand-gearing mechanism and a hand-exercise base to make the handles rotate successively and in reciprocal cycles so that the hands, neck and muscles of the hands, arms and upper body of the exerciser simultaneously be exercised.

OBJECT OF THE INVENTION

The primary object of the present invention is to provide a multi-functional stationary bike which provides the user with a sufficient quantity of exercise for simultaneously exercising the muscles of the lower and upper body.

Another object of the present invention is to provide the muscles of the upper body of the user sufficient extensions on such stationary bike.

Still another object of the present invention is to provide the muscles of the lower body of the user with more practices than are presently available with the use of the conventional stationary bike.

Yet another object of the present invention is to provide a kind of multi-functional stationary bike to the exerciser on which he can move all of his bodily muscles simultaneously.

These and other objects of the present inventions will become apparent from a reading of the following specification taken in conjunction with the enclosed drawings.

DESCRIPTION OF THE PREFERRED EMBODIMENTS

Figure 1:
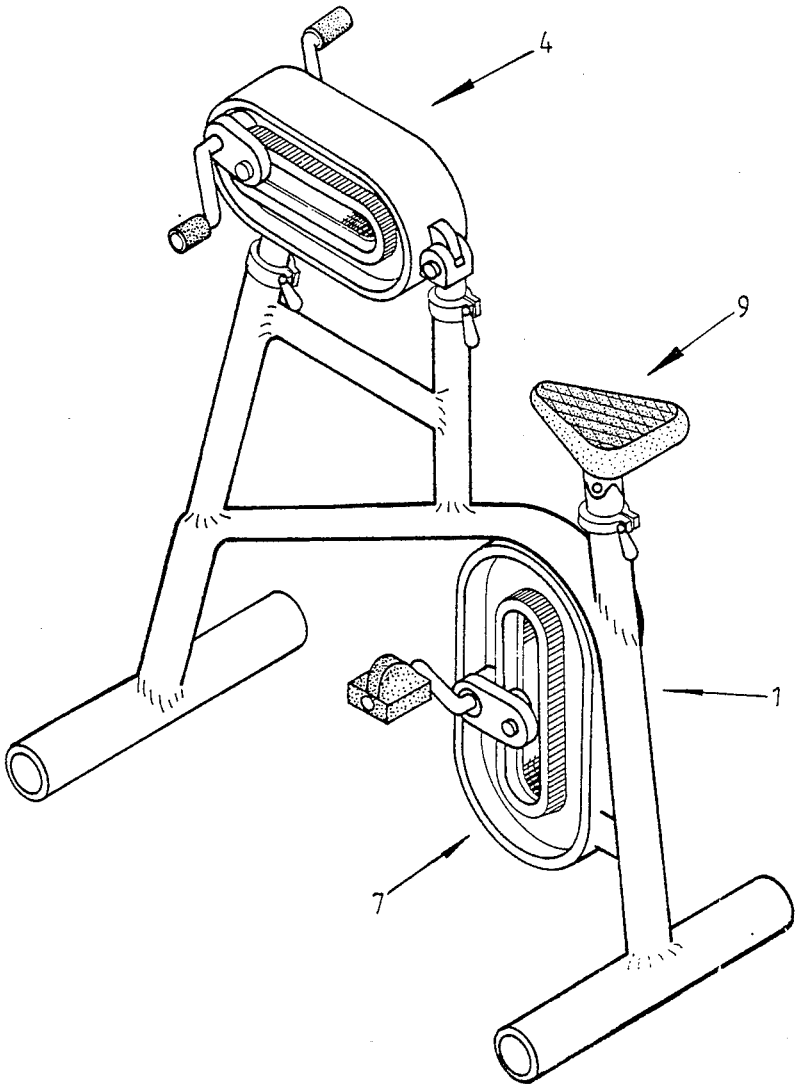
FIG. 1 is a perspective view of the stationary bike of the present invention with the guard cover removed therefrom for the sake of clarity.
Figure 2:
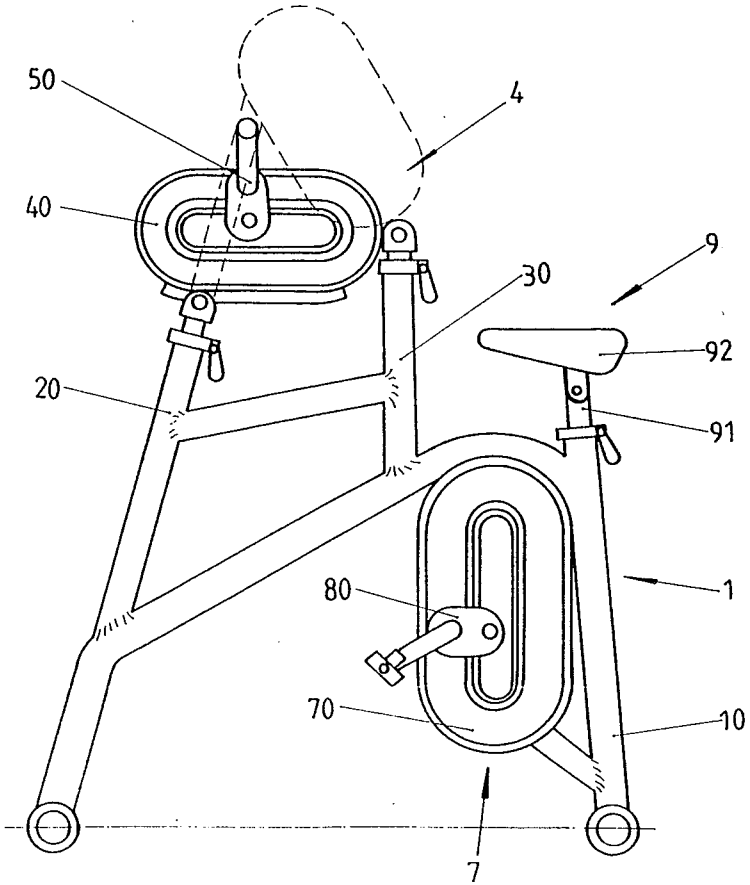
FIG. 2 is aside view of the multi-functional stationary bike in the present invention, in which the dotted lines show the movement of the hand-exercise mechanism when the moving rod is raised.
Figure 3:
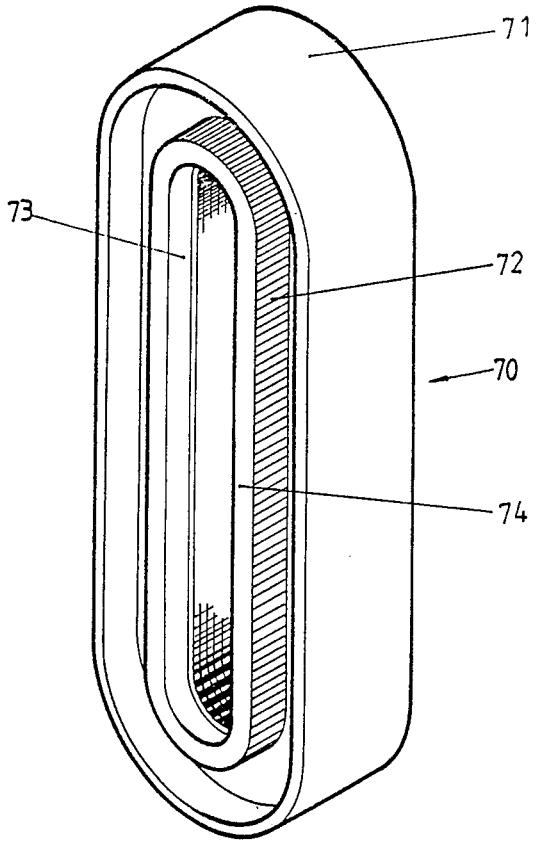
FIG. 3 is a perspective view of the foot-exercise mechanism on the multi-functional stationary bike.
Figure 4:
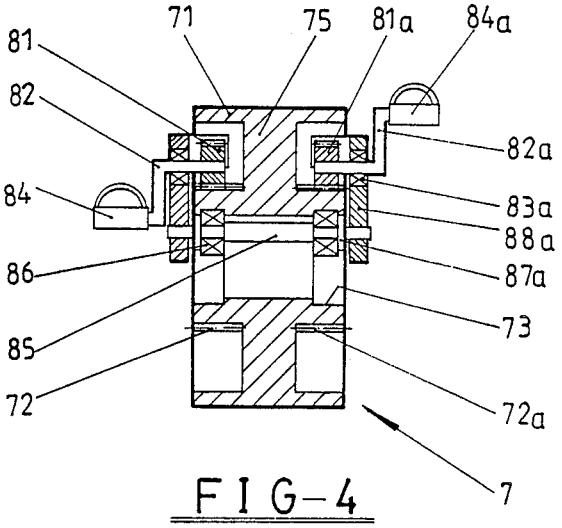
FIG. 4 is a cross-sectional view of the assembly of the foot-exercise mechanism of the multi-functional stationary bike of the present invention, showing the relationship between the foot-gearing mechanism and gear rack.
Figure 5:
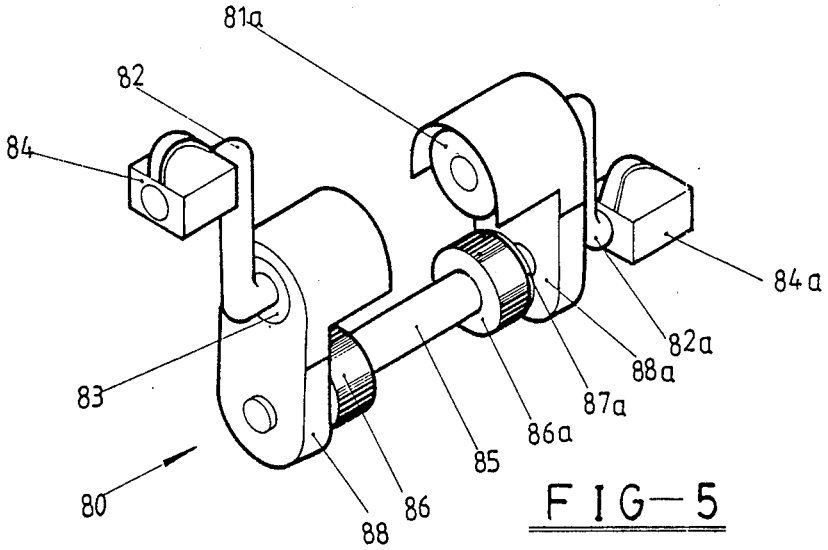
FIG. 5 is a perspective view of the foot-gearing mechanism of the multi-functional stationary bike in the present invention.
Figure 6:
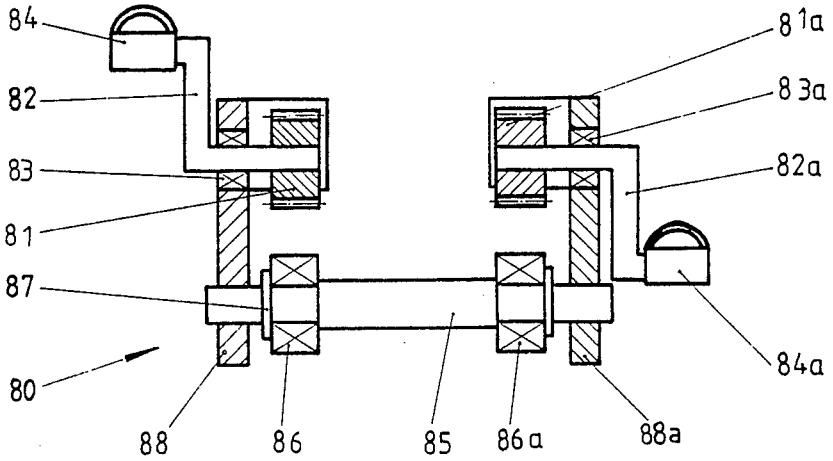
FIG. 6 is a cross-section view of the assembly of the foot-gearing mechanism of the multi-functional stationary bike of the present invention.

The present invention provides a multi-functional, stationary bike including a bike frame 1, and extension seat 9, a hand-exercise mechanism 4 and a foot-exercise mechanism 7. The extension seat 9 is carried by the upper portion of the bike frame 1 above the foot-exercise mechanism. The hand-exercise mechanism creates reciprocal movements to exercise the wrists, arms, torso and neck of the exerciser's upper body, and the foot-exercise mechanism also creates reciprocal movements to exercise the users body including feet, so that in combination with the hand-exercise mechanism, the complete exercise of the user's body can be achieved.

With particular reference now to FIGS. 2–6, the foot-exercise mechanism 7 is substantially oval in shape, and includes a foot-exercise base 70 and a foot-gearing mechanism 80. The foot-exercise base 70 is slightly oval in shape. Its cross section shows the shape of a character "I" and is fixed at the lower portion of the bike frame 1. The foot-exercise base 70 includes an outer plate 71 having an inner side and an outer side, an inner plate 74 having an inner side and an outer side stable plate 75. The stable plate 75, connects the inner side of the outer plate 71 and the outer side of the inner plate 74 uniting these plates such that respective left sides and right sides are defined on each of the inner side of the outer plate and the outer side of the inner plate, the outer plate 71 is arranged about the outer side (outside) of the foot-exercise base 70. The inner plate 74 is installed about the inner side of the foot-exercise base. The two sides of inner plate 74 are parallel to and are symmetrical with the sides of the outer plate 71. These two inner (left and right) sides of the inner plate are equipped with, respectfully, the left and right ring gear racks 72, 72*a*. The inner side or the inner plate 71 opposite to the left and right ring gear racks are provided having, rspectively, left and right concave grooves formed therein. The foot gearing mechanism 80 engages the foot-exercise base 70. The foot-gearing mechanism 80 includes left and right pedals (foot pedals) 84, 84*a*, left and right cranks (foot pedal shafts) 82, 82*a* left and right gears 81, 81*a*, left and right stable plates (fixation plates) 88, 88*a*, left and right bearings 83, 83*a*, left and right roll bearings 86, 86*a* left and right stop collars 87, 87*a*, left and right guard covers 89, 89*a*, and a positioning shaft 85. The positioning shaft 85 has a left and a right opposite end, each of which is reduced in cross-section. About the ends of the positioning shaft 85 are positioned the left and right roll bearings 86, 86*a*, respectively. The roll bearings 86, 86*a* are retained about the respective ends of the shaft by the left and right stop collars 87, 87*a*, respectively, and by the left and right fixation plates 88, 88*a* having respective lower ends and respective upper ends. The upper ends of the fixation plates 88, 88*a*, are respectively provided with the left and right bearings 83, 83*a*. The lower ends of the fixation plates 88, 88*a* are united and held by means of the positioning shaft 85 which extends therethrough. The left and right bearings 83, 83*a* are installed fo. association with, respectively, the left and right cranks 82, 82*a* to permit rotational movement of the cranks. The left and right cranks' inner sides are respectively installed with (connected to) the left and right gears, respectively, and the outer sides of the left and right cranks are respectively installed with the left and right pedals 84, 84*a* carried on the outer sides thereof. In this fashion, force on the pedals drives the cranks and the gears connected thereto. The left and right guard covers 89, 89*a* have a semi-circular shape, which are respectively installed on (carried by) the upper end of the two fixation plates and also covers the outer sides of the left and right gears 81, 81*a*, respectively, with the effect of the protection for safety. When the foot-gearing mechanism 80 engages the foot-exercise base, the left and right gears 81, 81*a* engage, respectively, the left and right ring gear rack moving the foot-gearing mechanism in the reciprocating upward and downward movements. The left and right roll bearings 86, 86*a* coordinate the engagement of the left and right gears 81, 81*a*, and roll frictionally in, respectively, the left and right concave grooves 73, 73*a*. The left and right gears 81, 81*a* coordinate the left and right roll bearings to clamp the gears in the left and right ring shape toothed slats (teeth) 72, 72*a* of the gear racks and the left and right roll bearings 86, 86*a* in the respective left and right concave grooves 73, 73*a* of the inner ring plate 74 in the upward and downward reciprocal directions, so that the foot-gearing mechanism can move the upward and downward in the foot-exercise base. The left and right roll bearings 86, 86*a* are fixed (retained) by the left and right stop collars 87, 87*a* and the positioning shaft 85. The roll bearings 87, 87*a* roll in the concave grooves 73, 73*a* so that the foot-gearing mechanism is fixed (clamped) and retained in the foot-exercise base 70 in upward and downward positions and further, so that, the foot-gearing mechanism steadily and smoothly runs in the foot-exercise base. When the foot-exercise mechanism is pedaled, the foot-gearing mechanism 80 moves in reciprocating upward and downward movements at the same time that the cranks rotate. In other words, not only does the foot-gearing mechanism move in a circular pedaling motion, but it also makes gradual upward reciprocal motion when the mechanism of the gears climbs or gradual downward reciprocal motion when the mechanism of the gears rolls downward. As the foot-gearing mechanism makes the gradual upward or downward rotations for exercise, it can also be used to impart the large extent of the upward and downward movements to other things. Thus, the muscles and lower part of the exerciser's body are given sufficient exercise.

When the parts in the stationary bike are assembled, the bearings 83, 83*a* are respectively installed on the fixation plates 88, 88*a* at their upper ends. Then the cranks 82, 82*a* are respectively journaled about the bearings 83, 83*a*. Next, the gears 81, 81*a* are respectively secured to the inner ends of the cranks 82, 82*a*. The pedals 84, 84*a* are respectively and firmly secured to and carried by the outer sides (ends) of the cranks 82, 82*a*. The guard covers 89, 89*a* are respectively installed on the upper ends of the fixation plates 88, 88*a*. The roll bearings 86, 86*a* respectively are positioned about the opposite ends of the positioning shaft to encase the two sides of the middle section with the larger diameter. The stop collars 87, 87*a* are fixed at the roll bearings 86, 86*a* of the positioning shaft on their outer sides (ends). Finally the two fixation plates 88, 88*a* are firmly united (secured in place) by the positioning shaft on the seat base 70 for the exercise of the foot.

The bike frame 1 (see FIG. 2) is made up of the forward section forward frame of the movable supporting frame 20, the main body 10 and the rearward frame 30. The lower portion of the bike frame under the seat is installed with (positioned) the foot-exercise mechanism 7.

Referring now to FIGS. 9–12, the main body 10 is the main structure of the bike frame. The forward frame 20 slants (declines) substantially backward slightly and includes a hollow rod 21, a C-clamp 22, a movable rod 23 and sliding block 25. The C-clamp 22 locks the movable rod 23 in place. The rod 23, in turn, slips upwardly and downwardly within the hollow rod 21. The sliding block 25 by means of the joint pin 24, can be connected with and carried by the upper end of the movable rod 23. The center of the top of the sliding block 25 had a guide groove 253 formed therein. The rearward frame (see also FIGS. 11 and 12) 30 also includes another respective hollow rod 35, another respective C-clamp 34, another respective movable rod 31, and a joint pin 32. The movable rod 31 is slidably disposed within the hollow rod 35 for being raised and lowered within and is locked in lace by another C-clamp 34. The upper section of the movable rod carries a joint 37 thereon, the two sides of the joint 37 have respective pin holes 33 formed therein. The inner sides of the upper section of the joint 37 are further provided with a turning groove 36 formed therein. When the movable rod 23 in the forward frame 20 moves upward or downward (is raised or lowered), the hand-exercise mechanism 4 pivots about the joint pin 32 of the rearward frame 30. The sliding block 25 is locked firmly by means of the screws 26 to insure that the hand-exercise mechanism is properly held and mounted in the appropriate desired, selected angle. When the forward frame 20 and the rearward frame 30 expand or retract (are raised or lowered) simultaneously, the elevation (raising) and lowering of the hand-exercise mechanism 4 can adjust the hand mechanism to a desired angle and for the proper height of installation.

The extension seat 9 (FIG. 2) is positioned at the upper portion of the bike frame 1 above the foot-exercise mechanism. The extension seat 9 includes a movable rod 91 and seat 92. By means of the raising or lowering of the movable rod 91, the height of the extension seat can be adjusted.

Figure 7:
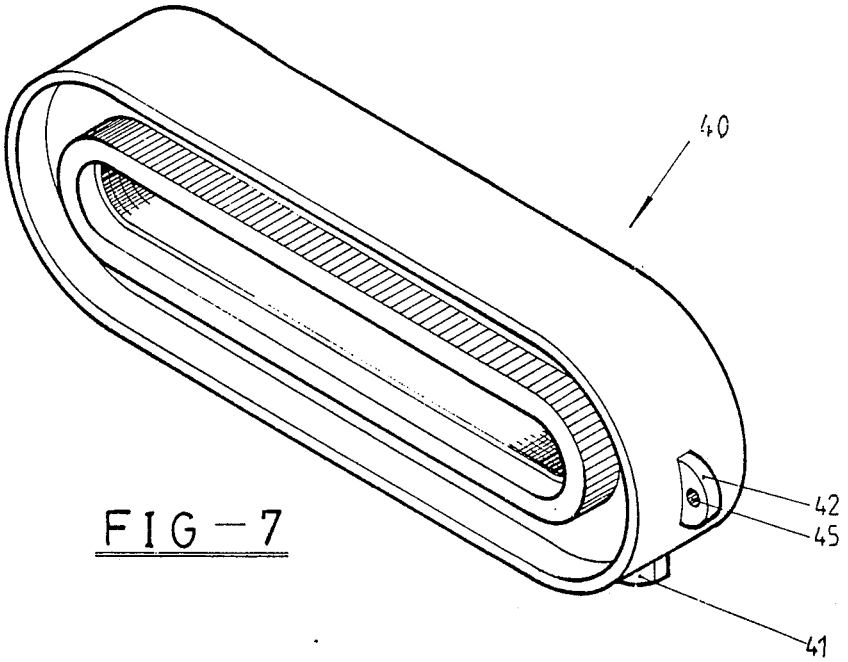
FIG. 7 is a perspective view of the hand-exercise base of the multi-functional stationary bike of the present invention.
Figure 8:
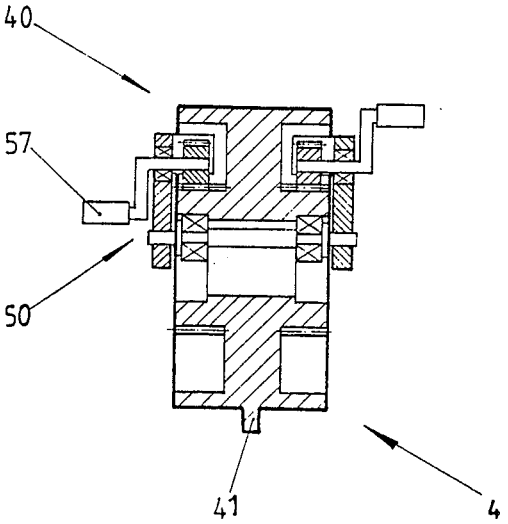
FIG. 8 is a cross-section view of the assembly of the hand-exercise mechanism of the multi-functional stationary bike in which the coordination relationship between the hand-gearing mechanism and hand-exercise base is demonstrated.
Figure 9:
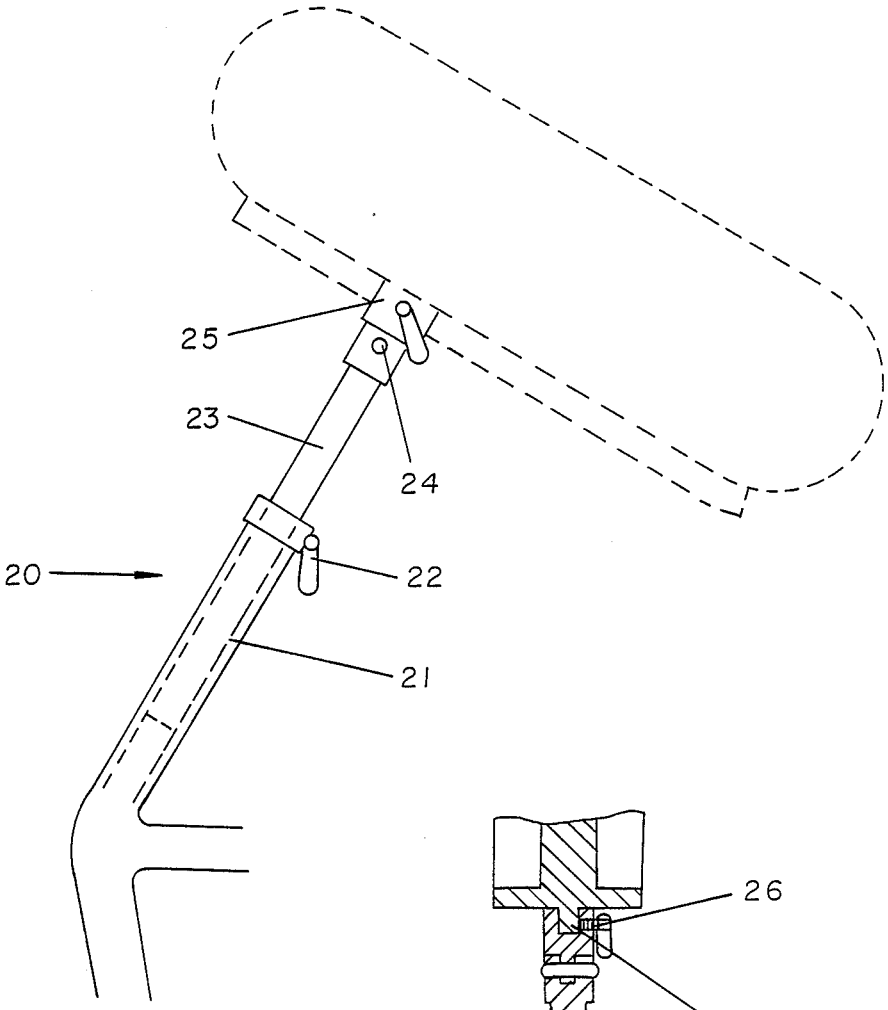
FIG. 9 is a side view of the forward frame of the multi-functional stationary bike of the present invention.
Figure 10:
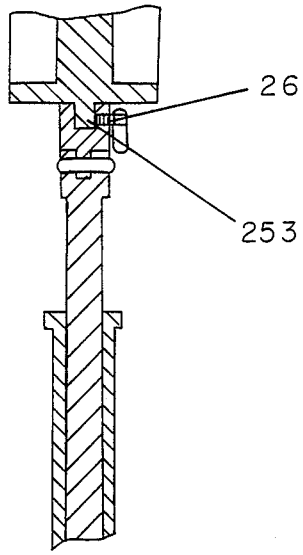
FIG. 10 is a cross section view of the movable frame of the multi-functional stationary bike of the present invention.
Figure 11:
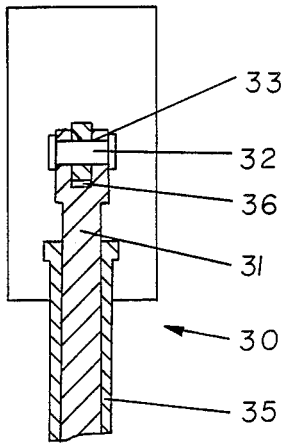
FIG. 11 is a cross section view of the rearward frame of the multi-functional stationary bike of the present invention.
Figure 12:
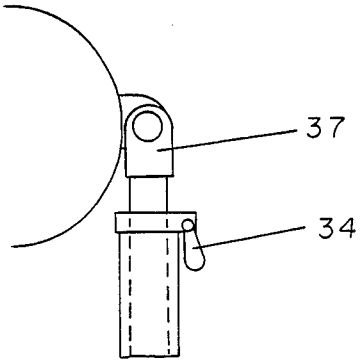
FIG. 12 is a side view of the rearward frame of the multi-functional stationary bike of the present invention.

With particular reference now to FIGS. 7–9, the hand-exercise mechanism 4 is horizontally installed at the upper portion of the rearward frame 30 and the forward frame 20 of the bike frame 1. It is comprised of the hand-exercise base 40 and the hand-gearing mechanism 50. The hand-exercise mechanism 4 is almost identical in structure, shape and function to the foot-exercise mechanism. The hand-exercise base has added a guide plate 41 secured to the bottom of the outer ring plate and an junction plate 42 secured to one of the ends of the mechanism 4 being of the semi-circular shape. The center of junction plate 42 is provided having a pin hole 45 formed therein through which pin 32 is received. This arrangement pivotally mounts the hand-exercise mechanism 4, including the hand-exercise base 40 to the rearward frame. To obtain the mountings in the various angles by means of the raising and lowering of the forward frame 20 and the rearward frame 30. Besides the pedal 84 in the foot-gearing mechanism may be modified into the shape of a handle grip 57. Like the foot-gearing mechanism, when the hand-gearing mechanism is rotated by the hand of the exerciser, the hand-gearing mechanism makes the reciprocal motions (forward and rearward) towards and away from the exerciser at the same time when the crank makes the turning (rotating) movement. That means that not only the hand-gearing mechanism makes the rotational reciprocal movement, but also it makes the gradual reciprocal movement towards and away from the user at the same time. The gradual reciprocating movement towards or away from the hand-gearing mechanism in relation to the exerciser causes the exerciser to crouch forward when the gears move far away from him and would also make him to lean backward when it comes towards him, thus the exerciser's body is driven forward and backward in the complex exerciser. At the same time when muscles and knuckles on the hands of the user rotate along the rotation of the stationary bike, the muscles on the torso and neck move in a forward and backward manner. Hence, the muscles of the exerciser's entire body as well as his knuckles on the hands get sufficient exercise. With the structure of the above components, the hand-gearing mechanism 50 in the hand-exercise mechanism 4 can make the reciprocal cycles in movement in relation to the user by the turning of the left and right cranks to cause the upper body of the exerciser's muscles in his hands, neck and torso and the knuckles in the hands to obtain sufficient exercise. The foot-exercise mechanism 7 causes the gears for the feet to move in relation to the exerciser so as to make the reciprocal cycles in movement by the turning of the left and right cranks. In this fashion, the feet, legs, and muscles on the thighs, knuckles and feet of the user can obtain sufficient exercise. The forward frame 20 and the rearward frame 30 permit the extension and retraction of the movable shaft, so as to permit the mounting and installation of the hand-exercise base at various angles for adjusting the base at upper and lower heights so as to change the directions the movements for the various kinds of muscles in the human body and their magnitudes.

Based upon the above statement, the present invention aids the muscles on the hands, neck and torso and knuckles on the hands in the upper part of the human body, and the muscles on the feet, thighs, hip and knuckles on the feet to obtain a sufficient quantity of exercise.

Obviously, many modifications may be made without departing from the basic spirit of the present invention. Accordingly, it will be appreciated by those claimed in the art that within the scope of the appended claims, the invention may be practiced other than has been specifically described herein.

What is claimed is:

1. A multi-functional stationary bike for gymnastic purposes, comprising:

a bike frame having a forward frame, a rearward frame and a main body, said forward frame and said rearward frame being able to be raised and lowered for the adjustment of their height and a pair of C-clamps, each clamp positioned for securing and locking one of the respective forward frame and the rearward frame in place at the desired adjusted height, said bike frame further having an upper portion and a lower portion;

a foot-exercise mechanism positioned at the lower portion of the bike frame, said foot-exercise mechanism having a base and a foot-gearing mechanism, said foot-gearing mechanism positioned for engaging the base when being rotationally driven, the foot-gearing mechanism further being carried by the foot-exercise mechanism for moving upwardly and downwardly in reciprocal movements about the base when the foot-gearing mechanism is driven;

a hand-exercise mechanism horizontally carried by the forward frame and the rearward frame of the bike frame, the hand-exercise mechanism including a base and a hand-gearing mechanism positioned for engaging the base when rotationally driven by the user, the hand-gearing mechanism further being carried by the hand-exercise mechanism for gradually moving towards and away from the user when the hand-gearing mechanism is driven;

an extension seat positioned at the upper portion of the bike frame above the foot-exercise mechanism, the extension seat including an adjustable movable rod and a seat, the seat carried by the movable rod for raising or lowering thereon for height adjustment;

such that the foot-gearing and hand-gearing mechanisms each rotate and translate when driven by the user, and further such that the height adjustment of the forward frame and the rearward frame provides various operative heights and angles of hand exercise.

2. The multi-functional stationary bike for gymnastic purposes of claim 1, wherein the foot-exercise base of the foot-exercise mechanism is substantially oval in shape having an inner side, an outer side and a cross section in the shape of an "I", said foot-exercise base having an outer plate including an inner side and an outer side, an inner plate including an inner side and an outer side and a stable plate including a left side and a right side, the stable plate being used to unite and hold the outer plate and the inner plate, the outer plate being arranged about the outside of the foot-exercise base, and the inner plate being installed about the inner side of the foot-exercise base, the two sides of the inner plate being parallel with the two sides of the outer plate, the stable plate positioned between and secured to the inner side of the outer plate and the outer side of the inner plate for uniting the inner and outer plates, such that a respective left side and a respective right side is defined on each of the inner side of the outer plate and the outer side of the inner plate, a left and a right ring gear rack, each of the left and right sides of the outer side of the inner plate being provided with, respectively, the left and right ring gear racks, of the inner plate positioned opposite to the left and right ring gear rack having, respectively, a left and a right concave groove formed therein.

3. The multi-functional stationary bike for gymnastic purposes of claim 2, wherein the foot-exercise base has left pedal and a right pedal, a left crank and a right crank, each of said cranks having a respective inside and a respective outside end, a left gear and a right gear, a left fixation plate and a right fixation plate, each of said fixation plates having respective lower ends and respective upper ends, a left bearing and a right bearing, left roll bearings and right roll bearings, a left stop collar and a right stop collar, a left guard cover and a right guard cover and a positioning shaft having a left end and a right opposite end, the ends of said positioning shaft being reduced in cross section, and the left and right roll bearings being respectively installed on the left and right ends of the shaft and being retained in place thereabout by means of the left and right stop collars respectively, so that the left and right roll bearings are able to roll in the left and right concave grooves of the inner side of the inner plate of the foot-exercise base, the lower ends of the left and right fixation plates having, respectively the left and right ends of the positioning shaft extending therethrough, the upper end of the left and right fixation plates being respectively equipped with the left and right bearings, the left and right bearings being positioned respectively for association with the left and right cranks for permitting rotational movement of the cranks in the upward and downward directions, the insides of the left and right cranks being connected, respectively, to the left and right gears, and the respective outsides of the cranks being connected to, respectively, the left and right pedals, the left and right guard covers being semicircular in shape, and further being secured to, respectively, the upper ends of the left and right fixation plates, and covering, respectively, the left and right gears, such that when rotated the foot-gearing mechanism is engaged, the left and right gears engage, respectively, the left and right ring gear rack, the left and right roll bearings coordinate the engagement of the left and right gears by fitting closely to and moving the gears in, respectively, the left and right concave groove, and further such that the foot-gearing mechanism moves in an upward and downward reciprocating manner on the foot-exercise base.

4. The multi-functional stationary bike for gymnastic purposes of claim 1, wherein said hand-exercise base has an outer plate, a pair of junction plates secured to one end of the outer plate on the hand-exercise base, the junction plates having a pin hole formed in the center thereof, the hand-exercise base having a guide plate, the hand-exercise mechanism being mounted at different angles and heights by pivotably joining the junction plate to the rearward frame and by slidably mounting the guide plate to the movable frame.

5. The multi-functional stationary bike for gymnastic purposes of claim 1, wherein said main body is an integral part of the bike frame, the forward frame declining substantially backward and said forward frame including a hollow rod having an upper end, a C-clamp installed on the upper end of the hollow rod, a movable rod disposed on the hollow rod and being able to move upwardly or downwardly within the hollow rod and a sliding block carried by the movable rod, said C-clamp being able to secure the movable rod expanding or retracting in place with the hollow rod, the top center of the sliding block having a guide groove formed therein, the rearward frame including another hollow rod having a top end, another C-clamp installed at the top end of the another hollow rod, another movable rod having an upper section, said another movable rod being disposed in the another hollow rod and being able to be raised and lowered within the another hollow rod, said another C-clamp being able to secure the another movable rod in place within the another hollow rod, the upper section of the another movable rod being pivotably secured to the hand-exercise base such that the raising and lowering of the rearward frame and the forward frame said hand-exercise mechanism is able to be mounted at the proper height, the joint pin of the mid-movable frame as the turning shaft, and using the screws to lock up and the sliding block with the guide plate of the hand-exercise base being received in the guide groove, so that the hand-exercise mechanism can be properly mounted at the appropriate angle.

6. A stationary bike, in combination of:

a bike frame including a lower portion and an upper portion;

a foot exercise mechanism including a foot pedal shaft having opposite ends extending therefrom, said foot pedal shaft being carried by the foot exercise mechanism for rotational movement, said foot exercise mechanism further including a pair of foot pedals, each foot pedal being carried by a respective opposite end of the foot pedal shaft, and a foot gearing mechanism for engaging the foot pedal shaft, such that the application of force upon the foot pedals rotates the foot pedal shaft and moves the foot pedals in upward and downward reciprocal movements in a substantially vertical plane;

a hand exercise mechanism including a hand pedal shaft having opposite ends extending therefrom, said hand pedal shaft being carried by the hand exercise mechanism for rotational movement, said hand exercise mechanism further including a pair of hand pedals, each hand pedal being carried by a respective opposite end of the hand pedal shaft, and a hand gearing mechanism for engaging the hand pedal shaft, such that the application of force upon the hand pedals rotates the hand pedal shaft and moves the hand pedals in forward and rearward reciprocal movements in a substantially horizontal plane;

a seat carried by the upper portion of the frame substantially above the foot exercise mechanism; and such that the simultaneous application of force on the hand pedals and on the foot pedals rotationally moves said pedals and simultaneously moves both the hand pedals in the forward and rearward reciprocating movements in the substantially horizontal plane and the foot pedals in the upward and downward reciprocating movements in the substantially vertical plane, whereby the hand pedals and foot pedals each rotate and translate when driven by the user.

* * * * *